US009421691B2

(12) United States Patent
Constantine

(10) Patent No.: US 9,421,691 B2
(45) Date of Patent: Aug. 23, 2016

(54) KNIFE WITH BLADE GUARD

(71) Applicant: Acme United Corporation, Fairfield, CT (US)

(72) Inventor: Richard S. Constantine, Milford, CT (US)

(73) Assignee: Acme United Corporation, Fairfield, CT (US)

( * ) Notice: Subject to any disclaimer, the term of this patent is extended or adjusted under 35 U.S.C. 154(b) by 182 days.

(21) Appl. No.: 14/197,871

(22) Filed: Mar. 5, 2014

(65) Prior Publication Data

US 2014/0250694 A1 Sep. 11, 2014

Related U.S. Application Data

(60) Provisional application No. 61/772,629, filed on Mar. 5, 2013.

(51) Int. Cl.
*B26B 29/02* (2006.01)
*B26B 9/00* (2006.01)

(52) U.S. Cl.
CPC *B26B 29/02* (2013.01); *B26B 9/00* (2013.01)

(58) Field of Classification Search
CPC ..... B26B 29/02; B26B 29/025; B26B 29/04
See application file for complete search history.

(56) References Cited

U.S. PATENT DOCUMENTS

| | | | | |
|---|---|---|---|---|
| 4,442,559 A * | 4/1984 | Collins | B26B 3/06 30/153 |
| 4,707,920 A * | 11/1987 | Montgomery | B26B 3/06 30/294 |
| 6,398,635 B1 * | 6/2002 | DeMezzo | A22C 29/024 30/120.1 |
| 7,647,701 B1 * | 1/2010 | Mollick | B26B 1/04 30/155 |
| 2009/0100683 A1 * | 4/2009 | Lion | B24D 15/084 30/138 |

* cited by examiner

*Primary Examiner* — Stephen Choi
(74) *Attorney, Agent, or Firm* — Alix, Yale & Ristas, LLP

(57) ABSTRACT

A knife with a guard assembly generally comprises a blade member, a handle assembly, and a blade guard assembly. The blade member includes a blade having a sharpened edge and an integral shank. The handle assembly is mounted to the shank. The blade guard assembly is mounted for pivotal movement about the blade member between a retracted position adjacent the handle to a protective position covering the sharpened edge. The blade guard is spring loaded by a spring about a pivot axis and a biased actuator secures the blade guard in the retracted position and the stable protective position. Upon depressing the actuator the blade guard assembly is pivoted to the protective position from the retracted position by a force of the spring.

17 Claims, 7 Drawing Sheets

KNIFE WITH BLADE GUARD

BACKGROUND

This disclosure relates generally to knives which are employed hunting, fishing, sporting and other related activities. More particularly, this disclosure relates to portable knives which employ a blade guard.

SUMMARY

According to aspects of the present disclosure, a knife with a blade guard assembly comprises a blade member, a handle assembly, and a blade guard assembly. The blade member includes a blade having a sharpened edge and an integral shank. The handle assembly is mounted to the shank and may include first and second handle heels mounted to first and second surfaces of the shank, respectively.

The blade guard assembly has a sheath which extends from a quasi-circular shoulder plate mounted for pivotal movement about the blade member. In one embodiment, the sheath includes an actuator arm disposed intermediate first and second sheath members and defining an intermediate channel. The blade guard assembly is spring loaded for pivotal movement about a pivot axis between a retracted position adjacent the handle and a protective position wherein the blade guard assembly covers the sharpened edge. A spring having a first end anchored to the shank and a second end anchored to the circular shoulder plate provides a biasing force necessary for pivotal movement of the blade guard assembly.

A biased actuator secures the blade guard in a stable retracted position and a stable protective position. Upon depressing the actuator the blade guard assembly is pivoted to the protective position from the retracted position by the force of the spring. In one embodiment the actuator is a spring biased button having a first enlarged diameter segment and a second small diameter segment. In an alternative embodiment the actuator is a spring loaded pusher having a detent which projects from a surface of the shank and selectively engages one of a pair of recesses defined in the shoulder plate to maintain the blade guard assembly in the protective and retracted positions.

The blade guard assembly provides a safety mechanism which may be manipulated with one hand to quickly transform the knife so that it may be stored without risking harm to the user. Furthermore, the blade guard assembly protects the sharpened edge of the blade from objects which might dull an exposed blade during storage.

DETAILED DESCRIPTION

Figure 1:
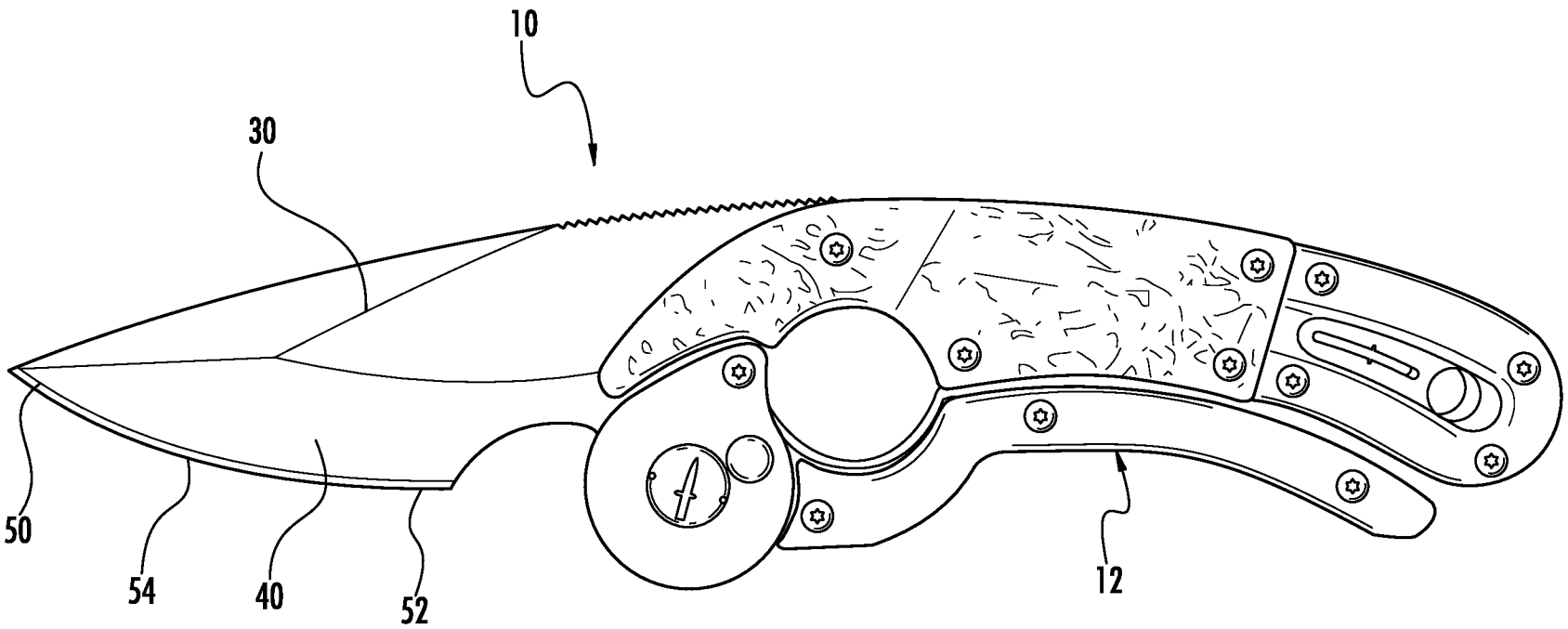
FIG. 1 is a front side view of a knife with a blade guard in the retracted position.
Figure 2:
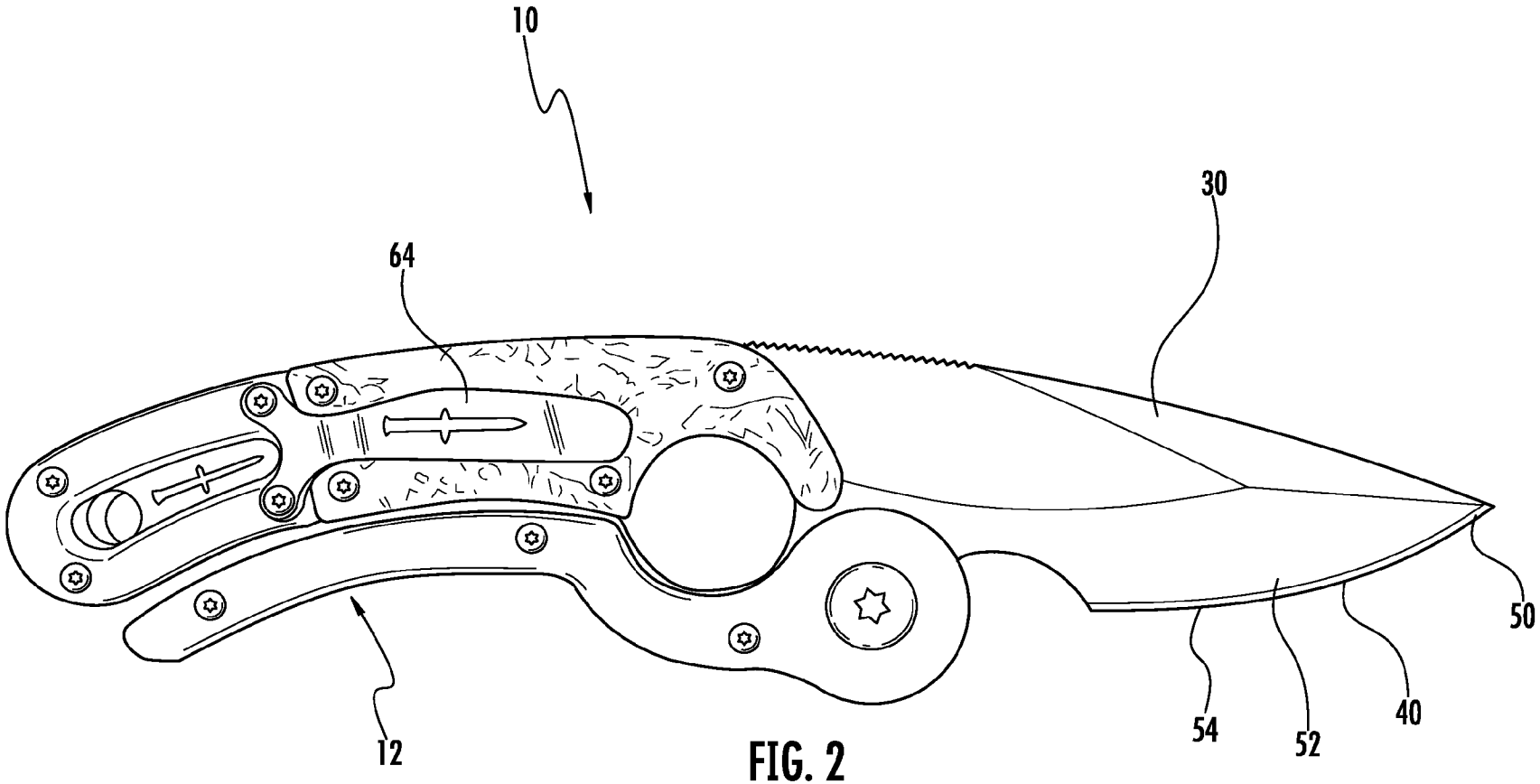
FIG. 2 is a rear side view of the knife of FIG. 1 with the guard in the retracted position.
Figure 3:
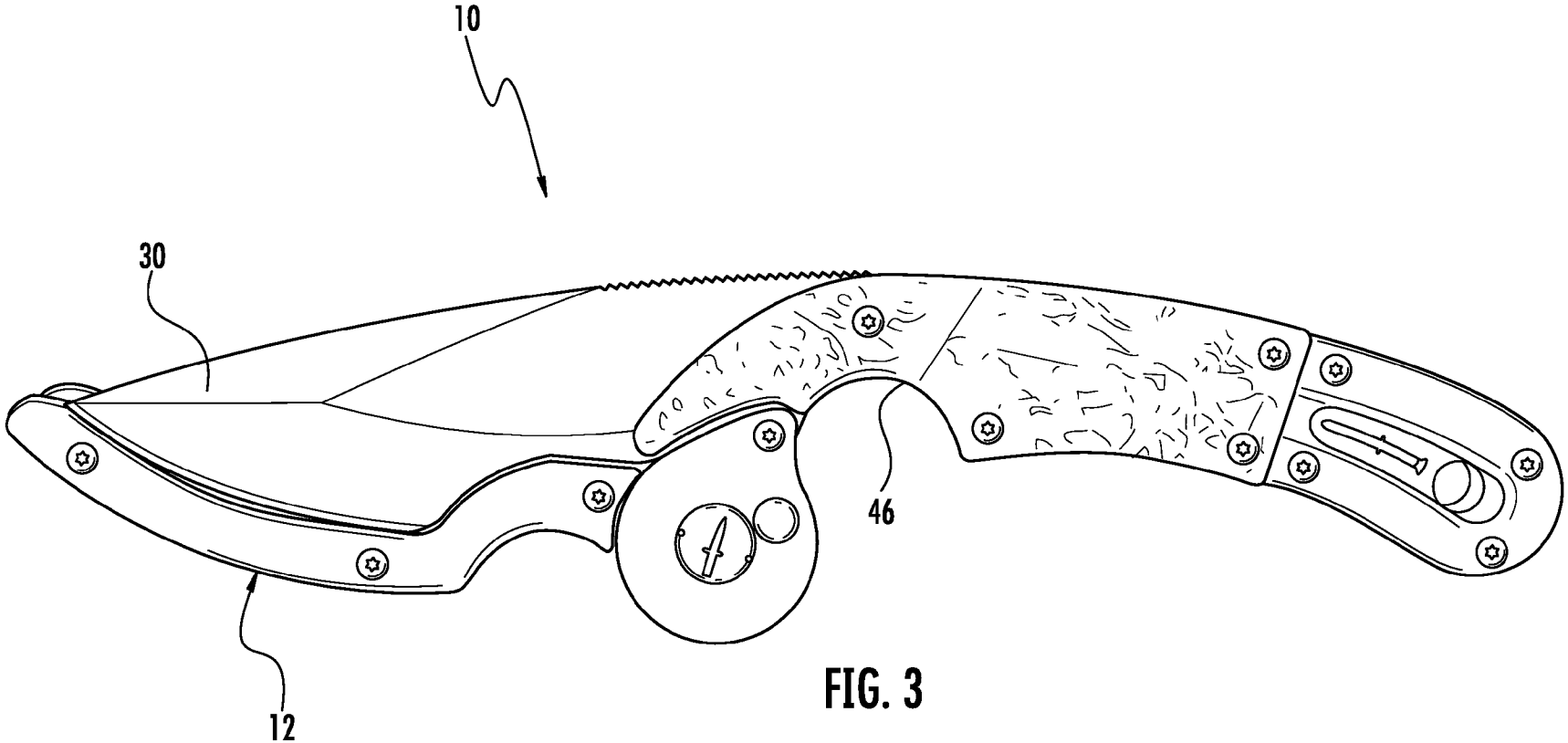
FIG. 3 is a front side view of the knife of FIG. 1 with the blade guard in the protective position.
Figure 4:
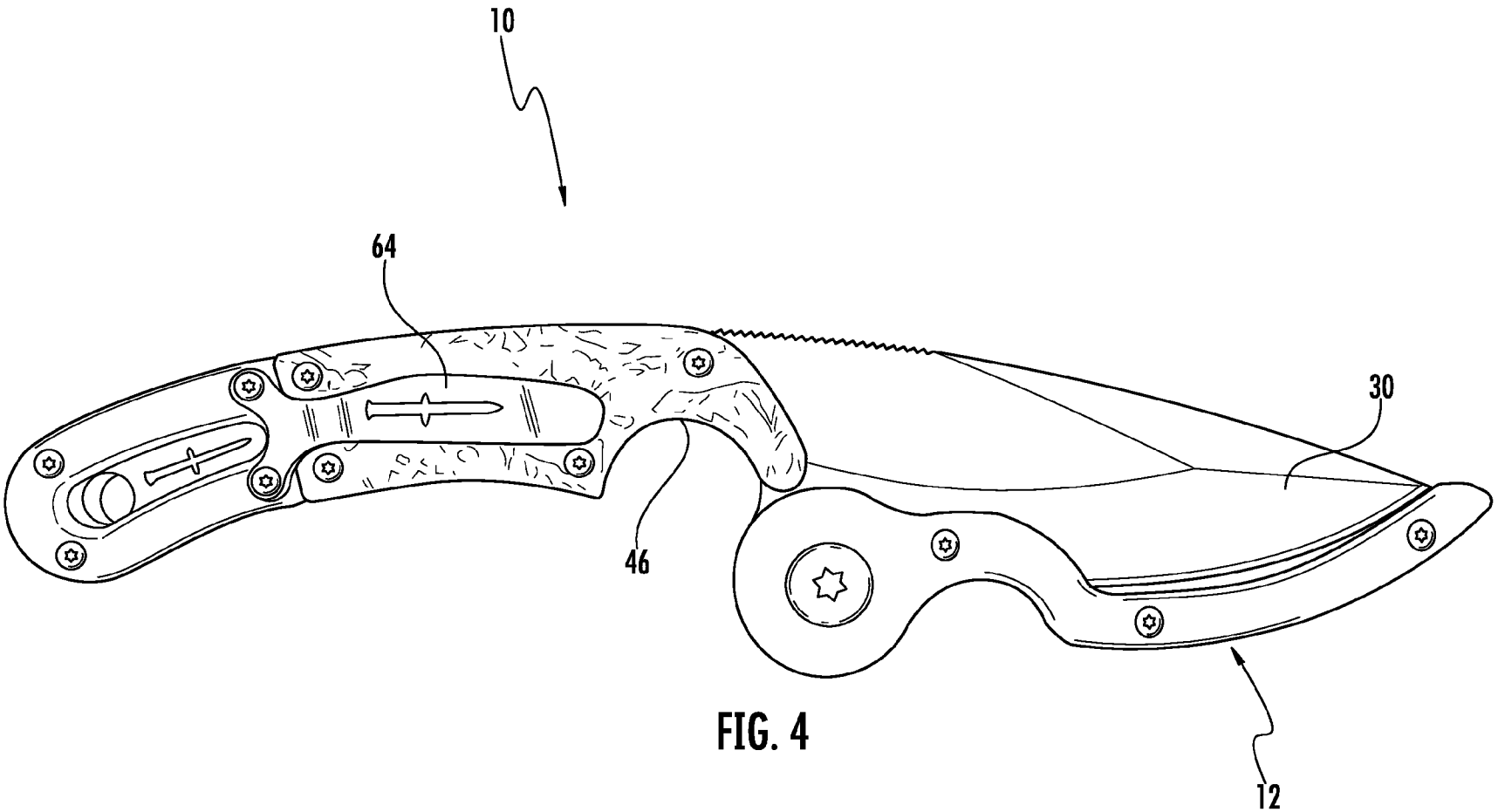
FIG. 4 is a rear side view of the knife of FIG. 1 with the blade guard in the protective position.
Figure 5:
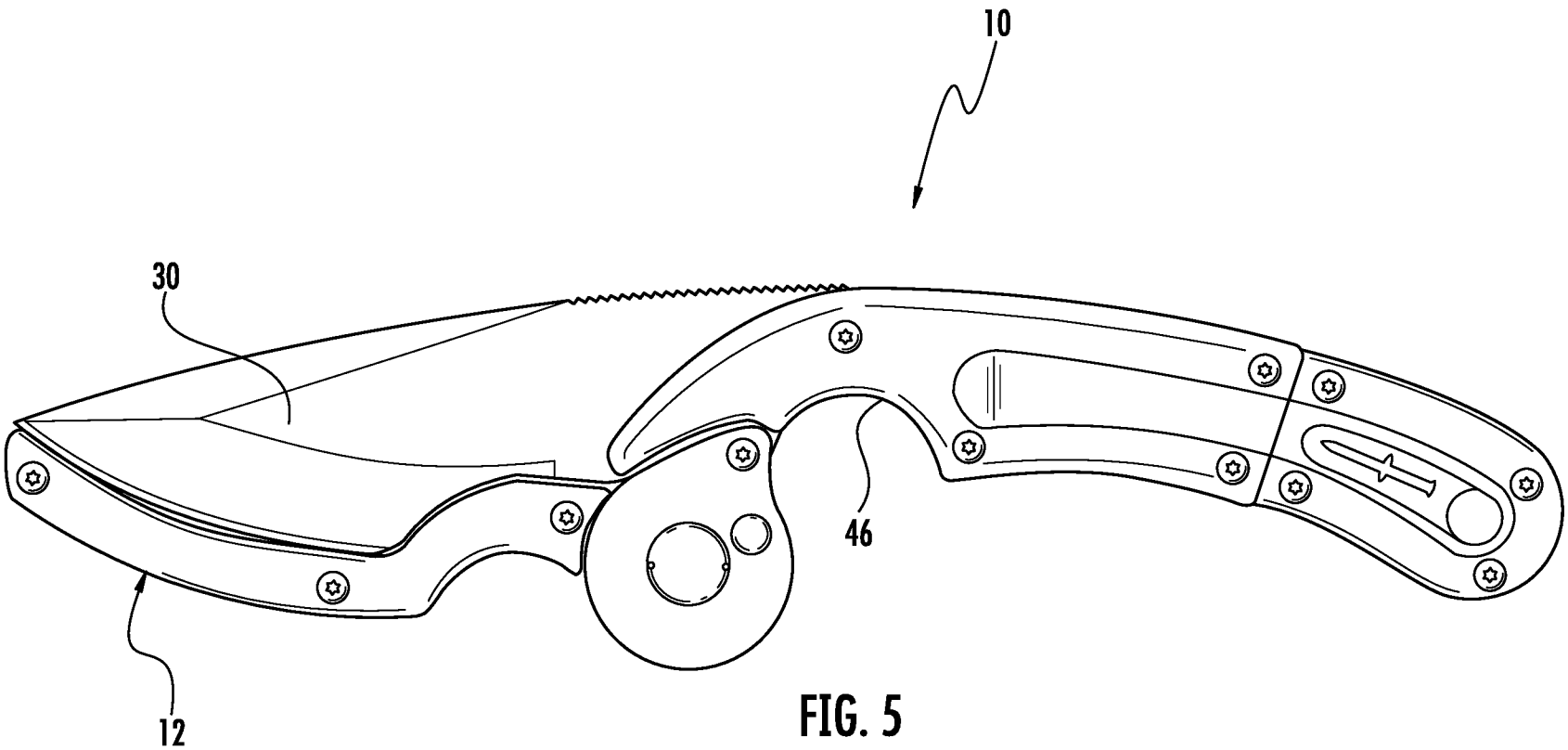
FIG. 5 is a front diagrammatic view of the knife of FIG. 1.
Figure 6:
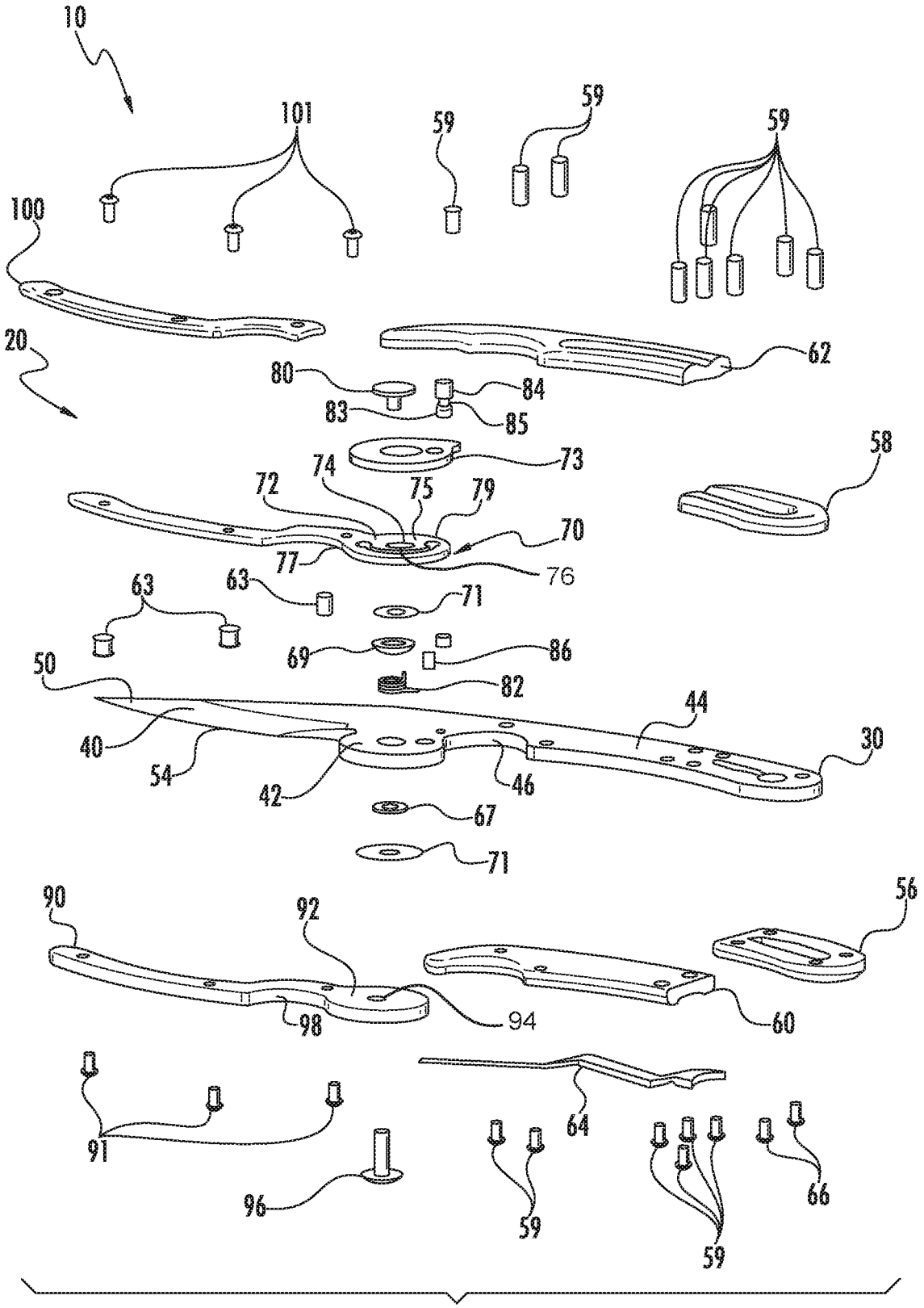
FIG. 6 is an exploded view of the knife with the blade guard of FIG. 1.

With reference to the drawings wherein like numerals represent like parts throughout the Figures, a knife with a spring loaded blade guard is generally designated by the numeral 10. The knife is adapted for use in connection with hunting, fishing, sporting and other outdoor activities. The knife has an ergonomic handle and employs a steel knife blade which is preferably coated with a carbon nitride titanium composition or other high quality, protective coating.

When the knife is being used, the blade guard 12 is disposed at a retracted position adjacent the handle. When it is desired to suspend usage of the knife, a spring loaded blade guard assembly 20 is easily activated by the user for placing the blade in a stable protective position. The knife 10 is also particularly adaptable for safe portability when not in active use whereby it may be easily protectively carried on a belt or in a pocket.

A blade member 30 includes a sharpened steel blade 40, an integral intermediate connector boss 42 and an integral shank 44. Shank 44 has an ergonomic contour with a recess 46 to facilitate grasping the knife. The blade member 30 functions as the principal support structure for the knife.

The blade 40 may assume numerous shapes and configurations, including a tapered forward V-shape point 50 adjacent a sharpened blade portion 52 which has a contoured or arcuate edge 54.

The proximal end of the shank 44 receives and mounts a pair of opposed handle heels 56 and 58 which are secured by screws 59 to the shank. Two aluminum side handles 60 and 62 are mounted to abut the forward end of the heels and are secured by screws 59 to the shank 44. A belt clip 64 is secured to one side of the handle by a rivet 66.

The blade guard assembly 20 comprises an actuator arm 70 extending from a circular shoulder plate 72. The plate 72 has a central opening 74 and a coaxial arcuate guide slot 76 terminating in a pair of enlarged openings 77 and 79. The plate also has a bore 75 offset from the opening 74. A mat 71 is disposed between the actuator arm 70 and the boss 42 of the blade member.

A rivet 80 extends through a mat 73 and through the opening 74 to pivotally secure the actuator arm 70 to the connector boss 42. A torsion spring 82 is wound around the pin of rivet 80. One end of the spring 82 is anchored in the bore 75 of the circular plate 72.

A lock button 84 is received in an opening of the mat at the underside of the button. The button 84 has a post which has an enlarged diameter segment 83 and a small diameter segment 85. The button 84 is biased by a compression spring 86 surrounding the post to a projected position wherein the enlarged segment 83 engages in either of the enlarged openings 77 or 79 of the actuator arms 70. The opposing sides of the blade member 30 are adjacent a pair of mats 67 and 69.

A left hand aluminum sheath member 90 has an enlarged circular shoulder plate 92 with an opening 94. A rivet or cap 96 engages through the opening and engages into the opposed rivet 80. The forward end portion of the left hand sheath has an arcuate portion with an intermediate recessed portion 98 which is congruent with that of the actuating arm. The sheath member 90 is secured to the actuating arm 70 by screws or rivets 91.

The right hand side of the actuating arm 70 receives a right hand sheath member 100 which is also secured by screws or rivets 101. Sheath member 100 has a geometric shape which is generally congruent to that of the actuating arm and the forward portion of the left sheath member 90. Screw barrels 63 are also employed in the guard assembly. Together, the two sheath members 90, 100 form an intermediate channel 110 which receives the sharpened blade edge 54 to provide a cover or sheath for the blade. Generally the members 90, 100 preferably have a complementary shape to that of the blade 40.

It will be appreciated that the intermediate portion of the button post has a reduced diameter segment 85 with a diameter which allows the guide slot to follow around the intermediate segment 85 when the guide slot and the intermediate segment align. Upon depressing the button 84, the torsion spring 82 thus will force the actuator arm to pivot in the direction of the arrows to the protective position. In the protective position, the compression spring 86 will force the lock button upwardly so that the enlarged segment 83 of the button is now received in the opening 79 to form a positive locked protective position.

When the blade guard is manually retracted to the retracted position, the spring will again force the button 84 to project so that the enlarged diameter segment 83 engages the opening 77, and accordingly thus secures the blade guard in a stable, secure, retracted locked position.

Figure 7:
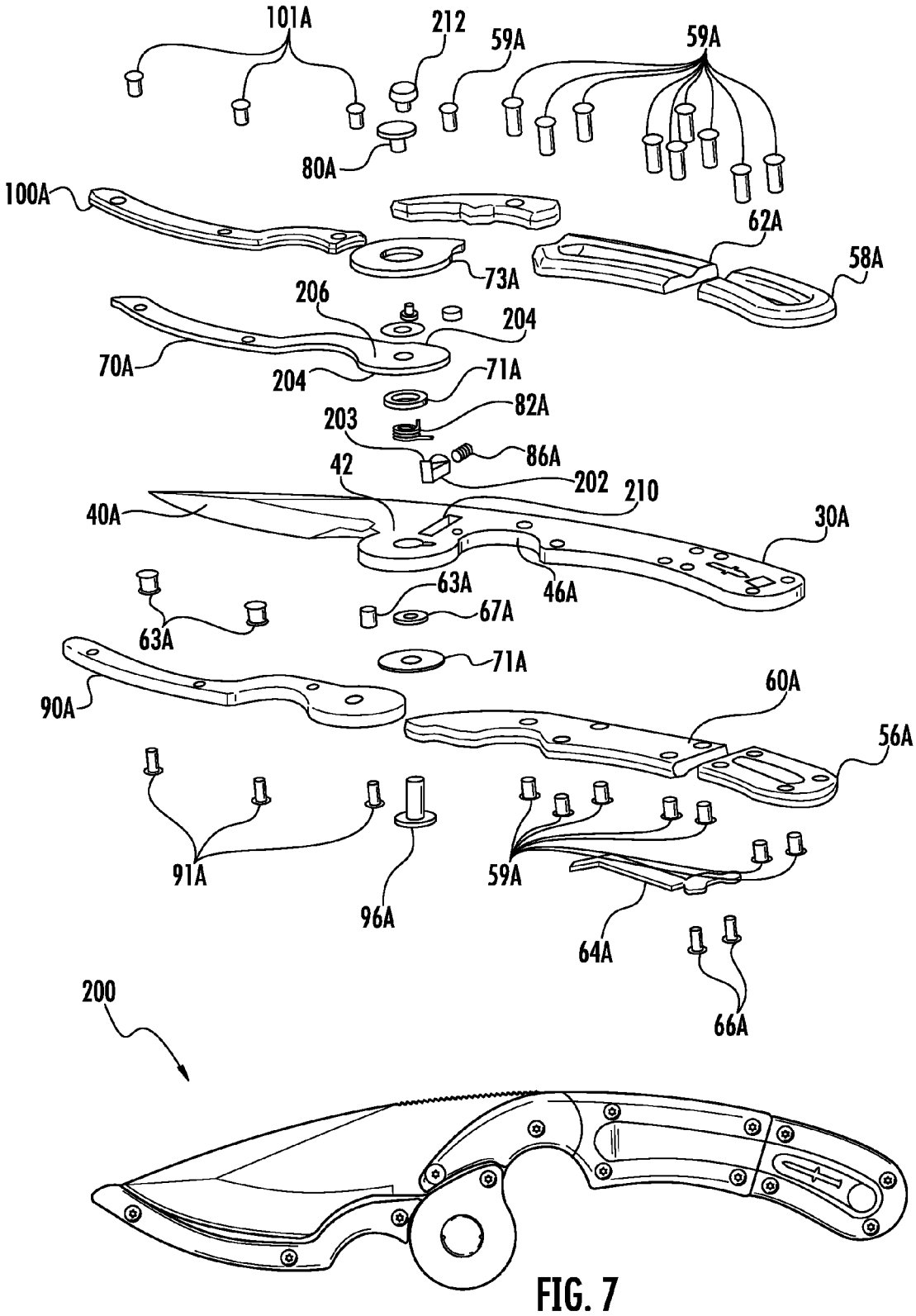
FIG. 7 is an exploded and an assembled view of another embodiment of a knife with a blade guard.

With reference to FIG. 7, another embodiment of a knife with a spring loaded blade guard is generally designated by the numeral 200. Knife 200 has substantially the same corresponding components and functions in a substantially similar way, except as described below. The components in knife 200 which correspond to those of knife 10 have the same numerical designation followed by the numeral A.

For knife 200, the position of the blade guard is secured by a spring-loaded pusher 202. The pusher 202 is captured in a slot 210. The pusher 202 forms a projecting detent 203 that engages against a flat edge of the plate 206 of the blade guard actuator arm 70A. Plate 206 has a pair of opposed recesses which define the flat edges 204 which are engaged by the detent in the protective and the retracted positions. A lock member 212 activates the pusher.

While a preferred embodiment has been set forth for purposes of illustration, the foregoing description should not be deemed a limitation of the invention herein. Accordingly, various modifications, adaptations and alternatives may occur to one skilled in the art without departing from the spirit of the invention and scope of the claimed coverage.

The invention claimed is:

1. A knife with a spring loaded guard assembly comprising:

a blade member comprising a blade with a sharpened edge and integral shank;

a handle assembly mounted to said shank; and a blade guard assembly comprising a sheath which covers the sharpened edge and being mounted for pivotal movement about said blade member between a stable retracted position adjacent said handle to a stable protective position covering said sharpened edge, said blade guard assembly being spring loaded by a spring configured to bias said blade guard assembly for pivotal movement about a pivot axis and having a biased actuator to retain said blade guard assembly in said stable retracted position and said stable protective position, said sheath comprising an arcuate arm extending from a quasi-circular shoulder plate defining a central opening coaxial with said pivot axis, said spring being a torsion spring having a first end anchored to said shoulder plate and a second end anchored to said shank, wherein said actuator comprises a spring loaded pusher having a detent which projects from a surface of said shank and said shank defines a slot adjacent said pivot axis sized to receive said pusher, a pair of recesses extend radially inwardly from a circumferential periphery on opposite sides of said shoulder plate, and said detent selectively engages one of said recesses to maintain said blade guard assembly in said protective and retracted positions and upon depressing said actuator, said blade guard assembly being pivoted to the protective position from said retracted position by a force of the spring.

2. The knife of claim 1, wherein the shoulder plate defines an arcuate guide slot circumscribing said central opening and having first and second ends, said first and second ends each defining an enlarged opening.

3. The knife of claim 2, wherein the biased actuator includes a first enlarged diameter segment configured to selectively engage said enlarged openings at said first and second ends in said retracted and protective positions, respectively, and a small diameter segment designed to engage said arcuate guide slot intermediate said retracted and protective positions.

4. The knife of claim 1, wherein said arcuate arm is disposed intermediate first and second sheath members of said sheath and a plurality of connectors secure said first and second sheath members to said actuator arm.

5. The knife of claim 1, wherein said shank and handle assembly have an ergonomic contour, and said shank defines a recess proximate said blade.

6. The knife of claim 1, wherein said blade defines a recessed heel proximate said shank, and said blade guard assembly has a protruding arcuate segment configured to fit within said recessed heel in said protective position and to cooperate with said shank recess to define a protective forefinger ring in said retracted position.

7. A knife with a spring loaded guard assembly comprising:

a blade member comprising a blade with a sharpened edge and integral shank and defining a recessed heel proximate said shank;

a handle assembly defining a handle recess proximate said blade and having first and second handle heels mounted to first and second surfaces of said shank; and a blade guard assembly comprising an arcuate actuator arm extending from a quasi-circular shoulder plate disposed intermediate first and second sheath members, said actuator arm being spring loaded and mounted for pivotal movement about a pivot axis between a stable retracted position adjacent said handle to a stable protective position covering said sharpened edge, said blade guard assembly having an arcuately protruding segment adjacent said shoulder plate, a spring having a first end anchored to said circular shoulder plate and a second end anchored to said shank, and a biased actuator securing said blade guard in said retracted and protective positions;

wherein upon depressing said actuator, said blade guard assembly is pivoted to the protective position from the retracted position by a force of said spring; and wherein said protruding segment fits within said recessed heel in said protective position and cooperates with said handle recess to define a protective forefinger ring in said retracted position.

8. The knife of claim 7, wherein said shoulder plate defines an arcuate guide slot and a central opening, said guide slot circumscribes said pivot axis and includes first and second enlarged openings at first and second terminal ends, and said central opening is disposed coaxial with said pivot axis.

9. The knife of claim 8, wherein said actuator has first and second diameters and first and second spaced ends, said first diameter being larger than said second diameter, disposed at said first end and sized to fit within said enlarged openings and secure said blade guard assembly in said retracted and protective positions, and said second diameter is disposed intermediate said first and second ends and sized to fit within said guide slot during pivotal movement of said blade guard assembly between said retracted and protective positions.

10. The knife of claim 7, wherein the blade guard assembly has a complementary shape to that of the blade, and the first and second sheath members define an intermediate channel configured to receive the blade edge.

11. The knife of claim 10, wherein a plurality of connectors secure said first and second sheath members to said actuator arm.

12. The knife of claim 7, wherein said actuator comprises a spring loaded pusher having a detent which projects from a surface of said shank and said shank defines a slot adjacent said pivotal axis sized to receive said pusher, a pair of recesses extend radially inwardly from a circumferential periphery on opposite sides of said shoulder plate, and said detent selectively engages one of said recesses to maintain said blade guard assembly in said protective and retracted positions.

13. A knife with a spring loaded guard assembly comprising:

a blade member comprising a blade with a sharpened edge and integral shank;

a handle assembly mounted to said shank; and a blade guard assembly comprising a sheath which covers the sharpened edge and being mounted for pivotal movement about said blade member between a stable retracted position adjacent said handle to a stable protective position covering said sharpened edge, said blade guard assembly being spring loaded by a spring configured to bias said blade guard assembly for pivotal movement about a pivot axis and having a biased actuator to retain said blade guard assembly in said stable retracted position and said stable protective position, said sheath comprising an arcuate arm extending from a quasi-circular shoulder plate defining a central opening coaxial with said pivot axis, said shoulder plate defining an arcuate guide slot circumscribing said central opening and having first and second ends, said first and second ends each defining an enlarged opening, said biased actuator including a first enlarged diameter segment configured to selectively engage said enlarged openings at said first and second ends in said retracted and protective positions, respectively, and a small diameter segment designed to engage said arcuate guide slot intermediate said retracted and protective positions, and upon depressing said actuator, said blade guard assembly being pivoted to the protective position from said retracted position by a force of the spring.

14. The knife of claim 13, wherein said spring is a torsion spring having a first end anchored to said shoulder plate and a second end anchored to said shank.

15. The knife of claim 13, wherein said actuator comprises a spring loaded pusher having a detent which projects from a surface of said shank and said shank defines a slot adjacent said pivotal axis sized to receive said pusher, a pair of recesses extend radially inwardly from a circumferential periphery on opposite sides of said shoulder plate, and said detent selectively engages one of said recesses to maintain said blade guard assembly in said protective and retracted positions.

16. The knife of claim 13 wherein said arcuate arm is disposed intermediate said first and second sheath members of said sheath and a plurality of connectors secure said first and second sheath members to said actuator arm.

17. The knife of claim 13 wherein said shank and handle assembly have an ergonomic contour, and said shank defines a recess.

* * * * *